US005186653A

United States Patent [19]

Robert

[11] Patent Number: 5,186,653

[45] Date of Patent: Feb. 16, 1993

[54] SMOKE ALARM REMOTE DISCONNECT

[76] Inventor: Normand A. Robert, 25085 Firwood, Warren, Mich. 48089

[21] Appl. No.: 817,056

[22] Filed: Jan. 6, 1992

[51] Int. Cl.[5] ..... G08B 17/10

[52] U.S. Cl. ..... 439/500; 340/628; 439/507; 439/638

[58] Field of Search ..... 429/1, 97, 121; 439/500, 627, 507, 511-513, 638; 340/628, 693

[56] References Cited

U.S. PATENT DOCUMENTS 4,567,477 1/1986 Cormier ..... 340/628

4,600,314 7/1986 Theriault ..... 340/628

4,679,037 7/1987 Bryan et al. ..... 340/628

*Primary Examiner*—Neil Abrams

[57] ABSTRACT

A smoke alarm attachment which connects between a battery, used to provide power to the smoke alarm's circuitry and a battery connector of the smoke alarm. The attachment has a plug which, when pulled, interrupts the power to the smoke alarm thereby silencing the smoke alarm's warning device. The attachment provides an easy means for elderly and handicapped people to deactivate and reactivate smoke alarms that have been triggered by false sources of smoke, such as cigarette smoke or smoke produced by cooking.

2 Claims, 1 Drawing Sheet

SMOKE ALARM REMOTE DISCONNECT

BACKGROUND OF THE INVENTION

This invention relates to a means to disconnect a battery operated smoke detector from a remote location.

FIELD OF THE INVENTION

In many cases, smoke detector alarms are falsely activated by persons smoking cigarettes, by smoke from cooking or by steam from hot water.

These false alarms become annoying, and if the smoke or steam is not cleared within a reasonable time the smoke detector battery will be discharged and require replacement.

Where older or incapacitated persons occupy the dwelling they may not be able to reach the smoke detector to disconnect the battery when there is a false alarm, and the battery will be discharged. The battery may not be replaced right away, making the smoke detector useless for the people needing it the most.

A plug, to disconnect the battery power from the smoke detector, can be mounted at a convenient location making it possible to silence false alarms and conserve battery energy.

The plug, to reconnect the battery to the smoke detector, can easily be reinserted, after the smoke has been cleared, reactivating the smoke alarm.

This remote disconnect device is designed in such a way that tools are not required to install it. The conductor cord is threaded through an existing opening in the smoke detector cover.

DESCRIPTION OF THE PRIOR ART

The present method used to silence false alarms, on battery operated smoke detectors, is to disconnect the battery from the smoke detector and after the cause for the false alarm has been cleared, the battery must be reconnected in order for the smoke detector to operate. Removing of the battery usually requires some device to climb on, in order to reach the smoke detector, since most smoke detectors are mounted at the highest point in the room where they are the most effective.

SUMMARY OF THE INVENTION

The invention is a device that, when installed between a nine-volt size battery and a smoke detector's battery connector, will interrupt the flow of electricity from the battery to the smoke detector when a plug is pulled. The plug is located at the end of a two conductor electric cord.

The smoke alarm remote disconnect device is mounted directly to the battery, and the power from one pole of the battery will travel down the remote disconnect's electric cord, through the jack and the solid plug and back up the jack and the electric cord to the smoke detector's battery connector.

The other pole of the battery will remain in electrical contact with the smoke detector through the disconnect device.

The plug at the end of the remote disconnect's electric cord, preferably, is a bright color so that it is readily visible when it is inserted in the jack at the end of the electric cord.

The parts shown on the drawings are not drawn to scale for the purpose of clarity.

DETAILED DESCRIPTION OF THE INVENTION

Figure 1:
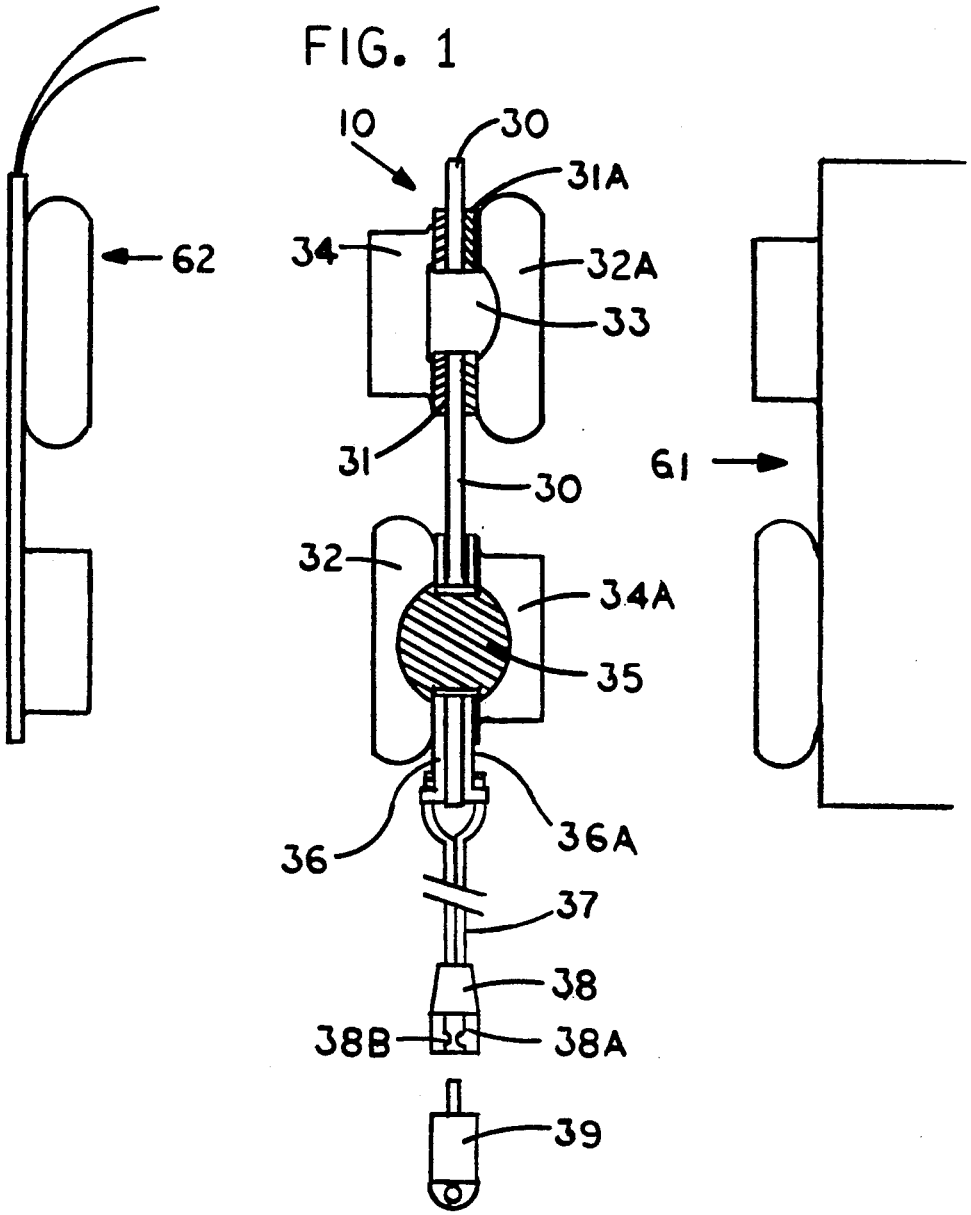
FIG. 1 is a drawing showing the remote disconnecting device positioned between a nine-volt battery and the smoke alarm's battery connector.
Figure 2:
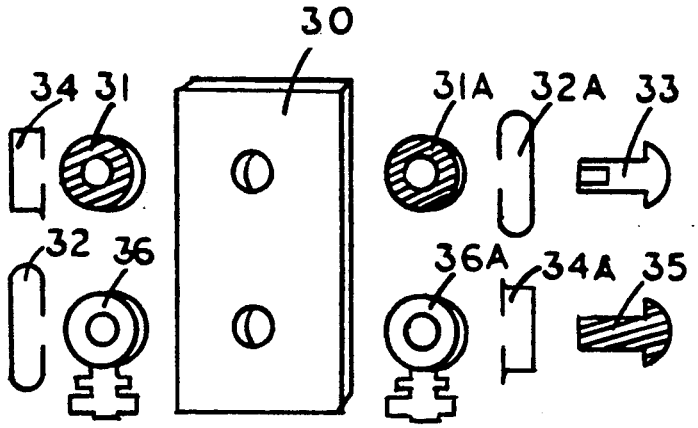
FIG. 2 is a drawing showing the individual components which make up the portion of the remote disconnecting device that is located between the battery and the smoke alarm's battery connector.

Referring now to the drawings, numeral 10 generally applies to the complete smoke detector remote disconnect assembly. As shown in FIG. 1, the components shown in FIG. 2 of the disconnect assembly 10 are installed between a 9 volt battery 61 and a plug of a smoke alarm (not pictured), and are located in the smoke detector housing. A long electrical cord 37, a jack 38 and a male plug 39 are threaded through an existing opening in the smoke detector housing and allowed to hang down to a convenient height. Excess cord footage, not needed, may be coiled about the smoke alarm. FIG. 2 shows the components of a portion of the disconnect assembly 10. The components of FIG. 2 are assembled as follows: A nylon rivet 35 is inserted through a male battery connector 34A, through a wire terminal 36A, through the hole of a fiber insulator 30, through the wire terminal 36, and through a female battery connector 32 at which point the nylon rivet 35 is then swagged with a hot iron.

Then a metal rivet 33 is inserted through the female battery connector 32A, through the fiber washer 31A, through the hole of the fiber insulator 30, through the fiber washer 31 and, finally, through the male battery connector 34 at which point the metal rivet 33 is swagged with a punch.

A two conductor cord 37 has one of its connectors connected to a wire terminal 36A as follows. The end of a conductor of the two conductor cord 37 is stripped of ⅛ inch of insulation, thereby exposing ⅛ inch of bare wire. The insulated portion of the conductor is then attached to the wire terminal 36A by crimping one tab of the wire terminal 36A around the wire insulation, to support the conductor, and the other tab of terminal 36A is crimped around the exposed bare wire of the conductor, thus, forming an electrical connection.

The same procedure, as outlined above, is used to connect the other conductor of the cord 37 to a wire terminal 36.

The cord 37 and a jack 38 are prefabricated items and are commercially available.

The plug 39 is made with a metal pin so that when it is inserted into the jack 38 the plug 39 bridges a gap between two conductors 38A and 38B of the jack 38, thereby permitting the electrical current to flow from one conductor of the cord 37 to the other conductor of the cord 37 through the jack 38. When the plug 39 is removed from the jack 38 the path for the electrical current through the cord 37 is interrupted.

The letter "A" has been added to some items in order to differentiate similar items for descriptive purposes.

It is not intended that the invention be limited to the particular embodiments illustrated and disclosed herein.

It is recognized that a person skilled in the art will be able to make changes without departing from the spirit of the invention as disclosed herein and set forth in the appended claims.

I claim:

1. A remote disconnect device for deactivating a smoke alarm, said remote disconnect device being installed between the battery of said smoke alarm and the battery connector of said smoke alarm, said remote disconnect device comprising:

an electric cord having a first end connected to said smoke alarm, and an opposite end extending in a direction away from said first end, said electric cord further comprising a first conductor and a second conductor;

means for connecting said electric cord to said battery of said smoke alarm and said battery connector of said smoke alarm;

a jack having a first conductor and a second conductor, said first conductor of said jack being connected to said first conductor of said electric cord at said opposite end of said electric cord, said second conductor of said jack being connected to said second conductor of said electric cord at said opposite end of said electric cord;

a plug having a first conductor and a second conductor, said plug being removably insertable in said jack, said first conductor of said plug being adapted to contact said first conductor of said jack, said second conductor of said plug being adapted to contact said second conductor of said jack, said first conductor of said plug being electrically connected to said second conductor of said plug, whereby when said plug is inserted in said jack, said battery is electrically connected to said smoke detector such that said smoke detector is operational, and when said plug is removed from said jack, said battery is electrically disconnected from said smoke detector such that said smoke detector becomes non-operational, such that when said smoke alarm is activated due to a false alarm, said plug may be removed to make said smoke alarm non-operational and said plug may be replaced once the source of said false alarm is removed, such that said smoke alarm becomes operational.

2. The remote disconnect device of claim 1 wherein said means for connecting said electric cord to said battery and said battery connector comprises:

a fiber insulator connected to said first end of said electric cord, said fiber insulator having a first side and an opposite side, said fiber insulator further comprising at least one passage therein extending from said first side to said opposite side;

at least one fiber washer having at least one passage therein aligned with a first of said at least one passage of said fiber insulator, a first of said at least one fiber washer being positioned on said first side of said fiber insulator;

at least one female battery connector having at least one passage therein aligned with said at least one passage of said first of said at least one fiber washer, a first of said at least one female battery connector being positioned on said first side of said fiber insulator;

at least one male battery connector having at least one passage therein aligned with said at least one passage of a second of said at least one fiber washer, a first of said at least one male battery connector being positioned on said opposite side of said fiber insulator;

at least one electrically conductive wire terminal having at least one passage therein aligned with a second of said at least one passage of said fiber insulator, a first of at least one said electrically conductive wire terminal being positioned on said first side of said fiber insulator, said at least one electrically conductive wire terminal being electrically connected to said first conductor of said electric cord;

a rivet passing through said at least one passage of said first of said at least one female battery connector, said at least one passage of said first of said at least one fiber washer, said first passage of said at least one passage of said fiber insulator, said at least one passage of a second of said at least one fiber washer, and said at least one passage of said first of said at least one male battery connector; and a nylon rivet passing through said at least one passage of a second of said at least one male battery connector, said at least one passage of said first of said at least one electrically conductive wire terminal, said second passage of said at least one passage of said fiber insulator, said at least one passage of a second of said at least one electrically conductive wire terminal, and said at least one passage of a second of said female battery connector, whereby said means for connecting receives said battery and said battery connector to establish communication therebetween.

* * * * *